United States Patent [19]

Copen

[11] 4,313,523

[45] Feb. 2, 1982

[54] AUTOMOTIVE EXHAUST SYSTEM INCORPORATING VENTURI TO REDUCE BACK PRESSURE

[76] Inventor: Dennis E. Copen, 11235 N. 15th St., Phoenix, Ariz. 85020

[21] Appl. No.: 162,125

[22] Filed: Jun. 23, 1980

[51] Int. Cl.[3] ..... F01N 1/14

[52] U.S. Cl. ..... 181/263; 181/225; 181/243

[58] Field of Search ..... 181/211, 225, 226, 259, 181/262, 263, 277, 296, 243

[56] References Cited

U.S. PATENT DOCUMENTS 1,292,283 1/1919 Faber ..... 181/225

1,560,947 11/1925 Skelton ..... 181/263

*Primary Examiner*—L. T. Hix

*Assistant Examiner*—Benjamin R. Fuller

*Attorney, Agent, or Firm*—Cahill, Sutton & Thomas

[57] ABSTRACT

A method and apparatus are provided for reducing back pressure within an exhaust system for an internal combustion engine by creating a venturi within the exhaust system and forcing air through the venturi to create suction for drawing exhaust gases away from the exhaust system. The exhaust system of a conventional automobile is modified by coupling one end of an air directing pipe to the tailpipe of the automobile near the outlet of the tailpipe and at an acute angle thereto for creating a venturi. Air is forced into the opposite end of the air directing pipe by an air scoop or a fan, and the forced air is directed through the outlet of the tailpipe for providing suction which draws exhaust gases out of the tailpipe.

7 Claims, 9 Drawing Figures

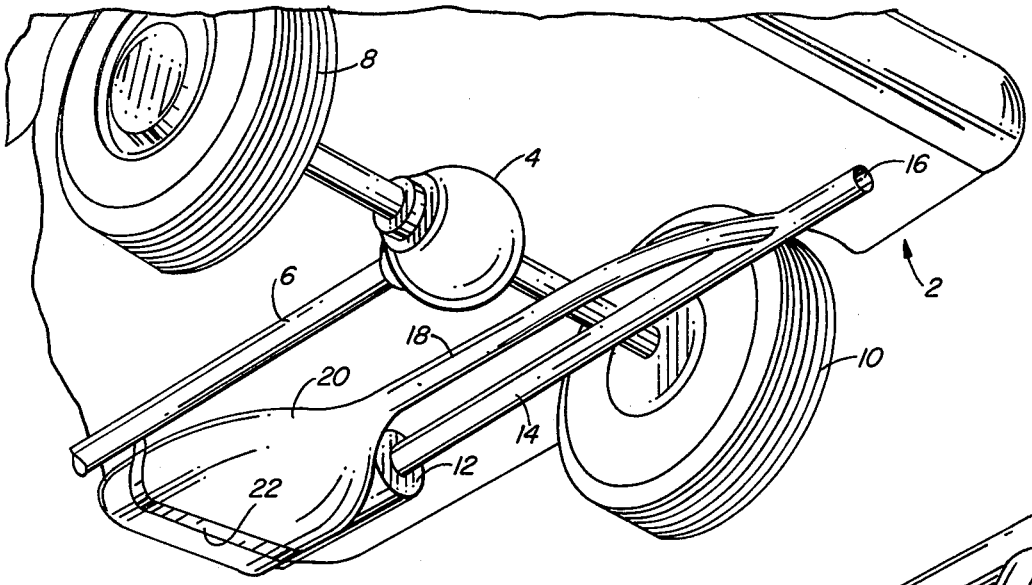
FIG. 1
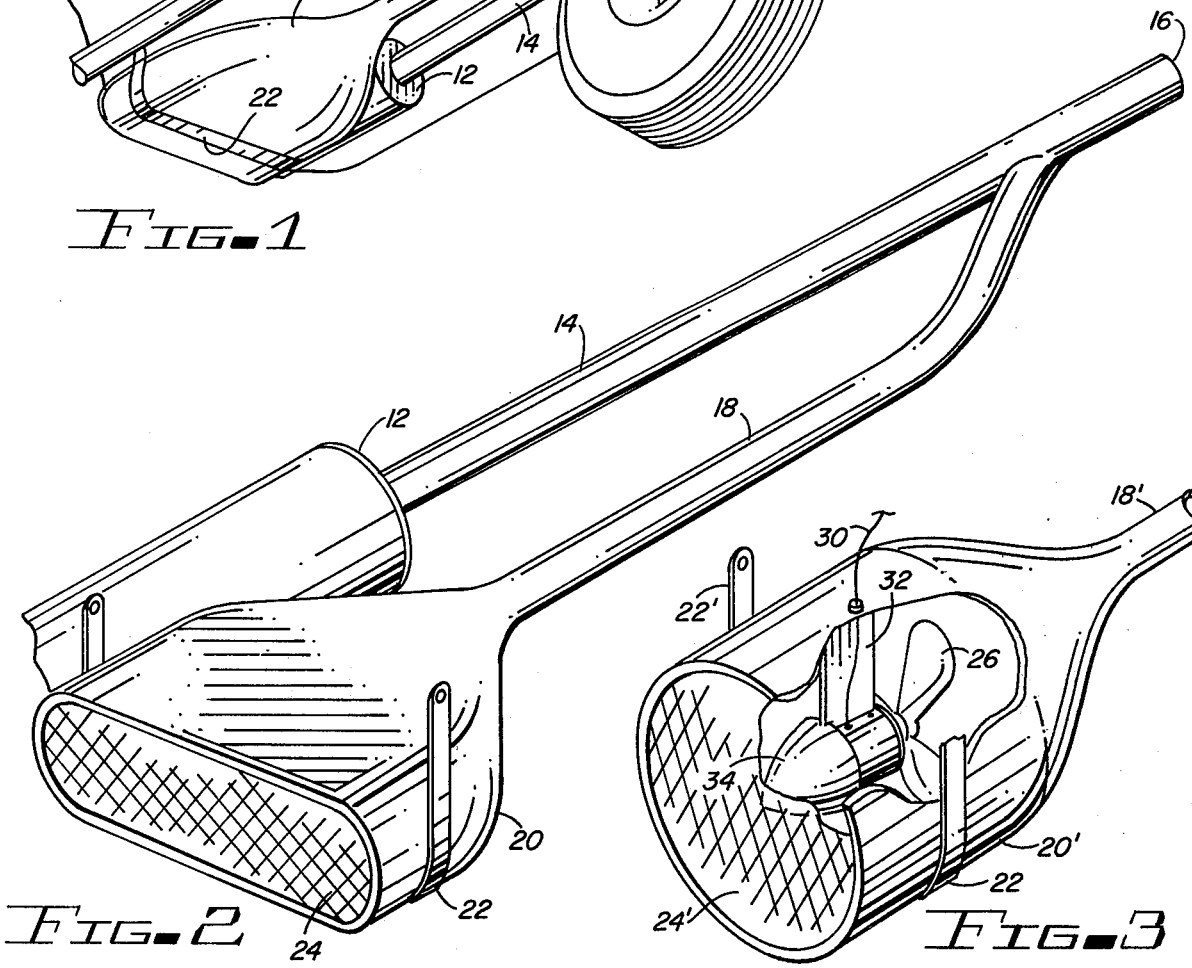
FIG. 2
FIG. 3
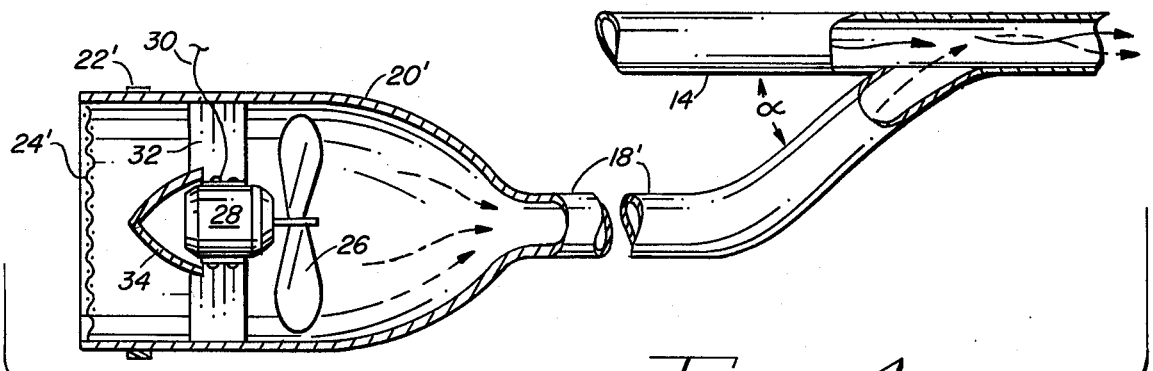
FIG. 4

AUTOMOTIVE EXHAUST SYSTEM INCORPORATING VENTURI TO REDUCE BACK PRESSURE

BACKGROUND OF THE INVENTION

1. Field of the Invention:

The present invention relates generally to exhaust systems for internal combustion engines, and more particularly, to a method and apparatus for reducing back pressure associated with such exhaust systems. p 2. Description of the Prior Art:

Vehicles powered by internal combustion engines typically include an exhaust system for expelling exhaust gases from the engine. For example, the exhaust system of a conventional automobile often includes an exhaust pipe connected at one end to the exhaust manifold of the engine and coupled at the opposite end to a muffler used to deaden the noise and vibration accompanying the escaping hot exhaust gases. More recently, emission control devices such as catalytic converters have been interposed between the engine and the muffler to reduce hydrocarbon and carbon monoxide pollutants from the exhaust stream. The outlet of the muffler is typically connected to a tailpipe which directs the exhaust gases toward the rear periphery of the underside of the automobile to prevent exhaust fumes from collecting below the underside of the vehicle. The tailpipes of some known models of automobiles also include a resonator to provide for optimum tuning characteristics of the exhaust system.

Back pressure developed by the exhaust gases within the exhaust system can result in a reduction in the efficiency of the expulsion of exhaust gases from the combustion chambers of the engine. Thus, an increase in back pressure developed by the exhaust system may result in a decrease in engine performance and a decrease in fuel efficiency. Accordingly, manufacturers of automobiles and other vehicles usually attempt to design such exhaust systems so as to present as little back pressure to the engine as possible. However, despite the attempts by such manufacturers to reduce the back pressure associated with automotive exhaust systems, such exhaust systems nonetheless continue to develop substantial back pressure which can degrade engine performance and fuel efficiency.

Accordingly, an object of the present invention is to improve the performance and fuel efficiency of an internal combustion engine.

Another object of the present invention is to reduce back pressure developed by exhaust gases within an exhaust system for an internal combustion engine.

Still another object of the present invention is to provide a method and apparatus for reducing back pressure developed by exhaust gases within an automotive exhaust system without adversely affecting the sound dampening and emission control functions of the exhaust system.

Yet another object of the present invention is to provide a method and apparatus for reducing back pressure developed by exhaust gases within an automotive exhaust system without adversely affecting the optimum tuning characteristics designed into the exhaust system by the manufacturer of the vehicle.

A further object of the present invention is to provide an apparatus which can be easily and inexpensively added to the conventional exhaust systems of both newly manufactured and pre-existing automobiles in order to reduce back pressure developed by exhaust gases within such automotive exhaust systems.

These and other objects of the present invention will become apparent to those skilled in the art as the description thereof proceeds.

SUMMARY OF THE INVENTION

Briefly, and in accordance with one embodiment thereof, the present invention relates to a method and an apparatus for reducing back pressure within an exhaust system of an internal combustion engine by creating a venturi within the exhaust system and by moving air through the venturi to create suction for drawing exhaust gases from the exhaust system. When the present invention is utilized in conjunction with an exhaust system of an internal combustion engine used to power a vehicle, an air scoop can be mounted to the vehicle in a predetermined direction for forcing air through the venturi when the vehicle is moved in the predetermined direction. A fan may also be provided for forcing air through the venturi when the vehicle is not being moved or is being moved relatively slowly.

Preferably, the venturi is created near the outlet end of a first pipe conventionally used to conduct exhaust gases away from an internal combustion engine. A second pipe is coupled to the outlet end of the first pipe at an acute angle for providing the venturi. Air is forced into the second pipe and is directed therethrough to the outlet end of the first pipe to create suction for drawing exhaust gases out of the first pipe.

BRIEF DESCRIPTION OF THE DRAWINGS

FIG. 1 is a perspective view of the rear portion of the underside of an automobile having an exhaust system modified according to the teachings of the present invention.

FIG. 2 is a perspective view of the modified exhaust system shown in FIG. 1.

FIG. 3 is a perspective view of an air scoop incorporating a fan.

FIG. 4 is a cross-sectional view of the air scoop shown in FIG. 3, and a cross-sectional view of a venturi provided near the outlet of an exhaust system.

DETAILED DESCRIPTION OF THE PREFERRED EMBODIMENT

Figure 5:
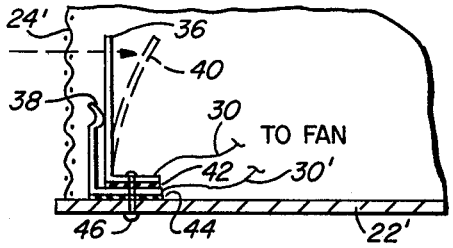
FIG. 5 is a cross-sectional view of a portion of the air scoop shown in FIG. 3 including a switch mechanism for controlling a fan.

In FIG. 1, the rear portion of the underside of an automobile 2 is shown including a differential gear assembly 4 for coupling drive shaft 6 to rear wheels 8 and 10. The exhaust system of automobile 2 includes a muffler 12 having its outlet end coupled to tailpipe 14 for expelling exhaust gases at outlet 16. An air directing pipe 18 has one of its ends coupled to and communicating with tailpipe 14 near outlet 16 for providing a venturi thereat. The opposite end of pipe 18 is coupled to an air scoop 20 having an opening directed toward the front of automobile 2. Air scoop 20 is secured to the underside of automobile 2 by mounting bracket 22.

As shown in FIG. 2, the forward facing opening of air scoop 20 includes a grill 24 for preventing rocks and other large debris from entering air scoop 20. The shape of air scoop 20 may be configured according to constraints imposed by the dimensions of the particular vehicle to which it is to be mounted. Satisfactory results have been achieved by utilizing an air scoop 20 having a generally circular forward facing opening measuring approximately ten inches in diameter for forcing air into an air directing pipe 18 measuring approximately one inch in diameter.

In FIGS. 3 and 4, a modified air scoop 20' is shown which includes a fan 26 driven by an electric motor 28 for forcing air into pipe 18'. Wire 30 is coupled between one terminal of electric motor 28 and a source of voltage for powering motor 28, a second terminal of motor 28 being grounded. A support member 32 supports electric motor 28 and fan 26 within air scoop 20'. Deflector 34 is attached to support member 32 directly ahead of motor 28 for minimizing turbulence within air scoop 20' due to the presence of motor 28.

In FIG. 5, an electrical switch mechanism is illustrated for controlling the operation of electrical motor 28 used to drive fan 26. The switch mechanism includes a flexible contact 36 and a rigid contact 38. An insulator 42 is disposed between the base portion of contact 36 and the base portion of contact 38. A second insulator 44 is disposed between the base portion of contact 38 and air scoop 22'. A fastener 46, insulated from contacts 36 and 38, attaches each of the switch elements to air scoop 22'.

With the vehicle at rest or moving at a relatively slow rate of speed, flexible contact 36 is biased toward contact 38 for closing the electrical circuit which powers electric motors 28. In this condition, wires 30 and 30' are electrically coupled for conducting current to motor 28. However, when the vehicle is moved at a relatively rapid rate of speed, the force of the air entering air scoop 22' deflects flexible contact 36 to dashed position 40 for opening the electrical circuit and shutting off electric motor 28.

The venturi provided by the junction of air directing pipe 18 and tailpipe 14 is best illustrated in FIG. 4. Pipe 18 (or 18') forms an acute angle, $\alpha$, with tailpipe 14. It has been determined that an angle, $\alpha$, of approximately 22 degrees provides satisfactory performance. Within FIG. 4, forced air collected by air scoop 20' or driven by fan 26 is indicated by dashed arrows. Exhaust gases flowing through tailpipe 14 are indicated by solid arrows. As high velocity forced air is directed by pipe 18 into the outlet portion of tailpipe 14, a low pressure area is created near the outlet of tailpipe 14. This low pressure area provides suction for forceably drawing exhaust gases out of tailpipe 14. It has been determined that optimal results are obtained by creating the above described venturi at a distance of approximately six inches from the exhaust system outlet. By assisting the withdrawal of exhaust gases from tailpipe 14, the venturi provided according to the teachings of the present invention effects a reduction in the back pressure developed within the exhaust system.

Figure 6:
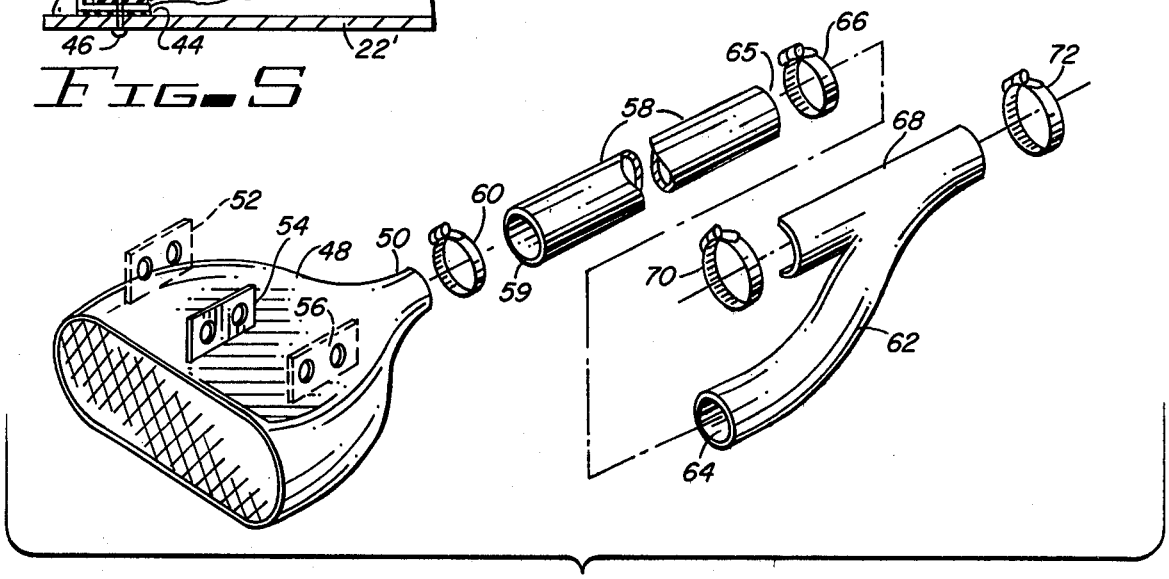
FIG. 6 is an exploded perspective view of an embodiment of the present invention shown in kit form for modifying a conventional exhaust system according to the teachings of the present invention.

FIG. 6 illustrates in exploded form a kit which may be provided for modifying a conventional automotive exhaust system to create a venturi according to the teachings of the present invention. The kit includes an air scoop 48 having a necked-down portion 50. Air scoop 48 may also be provided with various brackets 52, 54 and 56 for mounting air scoop 48 to a vehicle. A pipe 58 is provided for conducting air collected by air scoop 48. Pipe 58 has a first end 59 for mating with neck 50. A clamp 60 is provided for clamping first end 59 to neck 50. A coupling member 62 is also provided and has an inlet 64 for mating with the second end 65 of pipe 58. Clamp 66 is provided for clamping inlet 64 to second end 65. Coupling member 62 includes a semi-cylindrical portion 68 for abutting the tailpipe of a conventional automotive exhaust system near the outlet thereof. Clamps 70 and 72 are provided for clamping semi-cylindrical portion 68 to the tailpipe.

Figure 7:
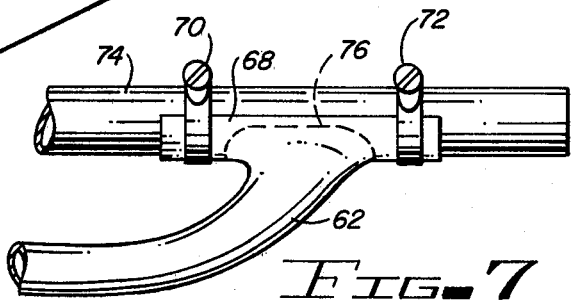
FIG. 7 is a top view illustrating the attachment of the kit shown in FIG. 6 to a conventional tailpipe.

In FIG. 7, coupling member 62 is illustrated after being clamped to tailpipe 74. Prior to clamping semi-cylindrical portion 68 to tailpipe 74, a hole, indicated by dashed line 76, is cut within tailpipe 74 near the outlet thereof for allowing air directed by coupling member 62 to flow through tailpipe 74. Semi-cylindrical portion 68 is then clamped over hole 76 to form a venturi.

Figure 8:
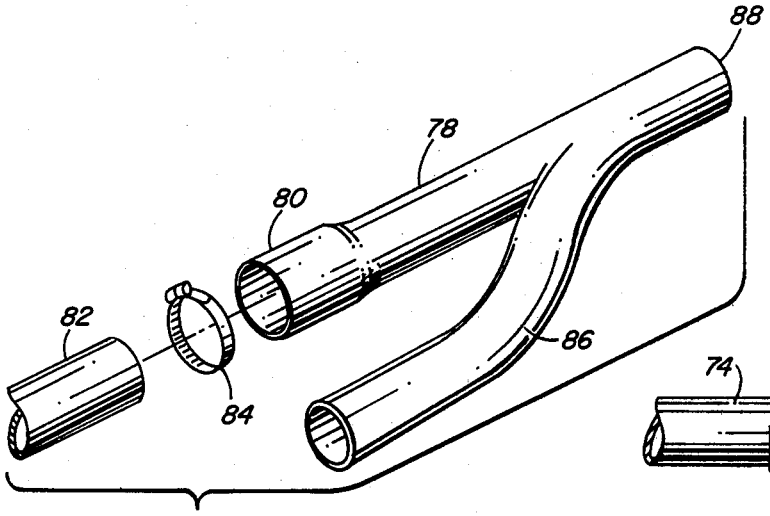
FIG. 8 is an exploded perspective view of a tailpipe and a venturi member for creating a venturi at the outlet of the tailpipe.
Figure 9:
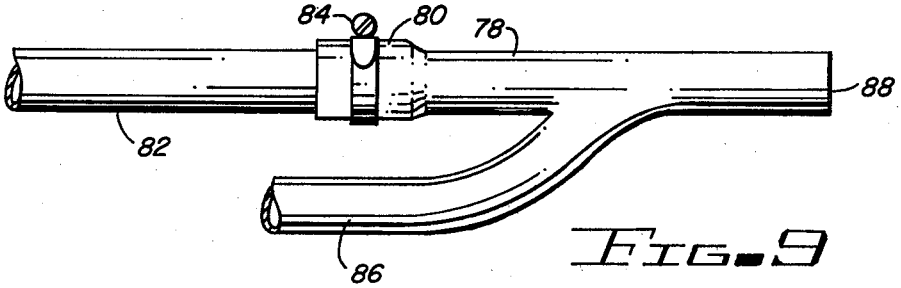
FIG. 9 is a top view of the venturi member shown in FIG. 8 after attachment to the tailpipe.

FIGS. 8 and 9 illustrate another apparatus for creating a venturi near the outlet of a tailpipe. Venturi member 78 includes an enlarged lipped portion 80 for engaging the end of conventional tailpipe 82. Clamp 84 is provided for clamping lipped portion 80 to tailpipe 82. Venturi member 78 includes angled pipe 86 for directing forced air into the venturi member 78 and out the outlet 88. Pipe 86 is joined to the body of venturi member 78 approximately six to twelve inches from outlet 88. Air is forced into pipe 86 via an air scoop or fan. Tailpipe 82 may be shortened prior to attachment of venturi member 78 thereto in order to compensate for the additional length of venturi member 78.

It will now be appreciated by those skilled in the art that a method and apparatus have been described for reducing back pressure associated with the exhaust system of an internal combustion engine. While the invention has been described with reference to a preferred embodiment thereof, the description is for illustrative purposes only and is not to be construed as limiting the scope of the invention. Various modifications and changes may be made by those skilled in the art without departing from the true spirit and scope of the invention as defined by the appended claims.

I claim:

1. An apparatus for modifying an exhaust system of a vehicle to reduce back pressure associated therewith, said exhaust system including a tailpipe having an outlet end, said apparatus comprising in combination:

(a) a pipe having first and second ends;

(b) means for forcing air into the first end of said pipe;

(c) a coupling member having a tubular inlet portion coupled to the second end of said pipe for receiving forced air and having a semi-cylindrical outlet portion for abutting the tailpipe of the exhaust system and for discharging the forced air received by said tubular inlet portion; and (d) means for securing said semi-cylindrical outlet portion of said coupling member in abutting relationship with the tailpipe of the exhaust system and in overlying relationship with a hole formed within the tailpipe near the outlet end thereof for creating a venturi within the tailpipe and for injecting forced air discharged by said semi-cylindrical outlet portion of said coupling member into the tailpipe toward the outlet end thereof in order to create suction within the tailpipe for drawing exhaust gases away from the exhaust system.

2. An apparatus as recited in claim 1 wherein said securing means comprises at least one band clamp extending around the tailpipe and extending around said semi-cylindrical outlet portion of said coupling member.

3. An apparatus as recited in claim 1 wherein said means for forcing air comprises an air scoop mounted to the vehicle and disposed in a predetermined direction for forcing air into the first end of said pipe when the vehicle is moved in said predetermined direction.

4. An apparatus as recited in claim 3 wherein said means for forcing air includes a fan mounted within said air scoop.

5. An apparatus as recited in claim 4 wherein said fan is powered by an electric motor.

6. An apparatus as recited in claim 1 wherein said means for forcing air includes a fan.

7. An apparatus as recited in claim 6 wherein said fan is powered by an electric motor.

* * * * *